US011952084B1

(12) United States Patent
Barker et al.

(10) Patent No.: US 11,952,084 B1
(45) Date of Patent: Apr. 9, 2024

(54) ADJUSTABLE SUPPORT FOR A DECK SEAT

(71) Applicants: Hubert T. Barker, Eubank, KY (US); Ronald T. Barker, Somerset, KY (US)

(72) Inventors: Hubert T. Barker, Eubank, KY (US); Ronald T. Barker, Somerset, KY (US)

( * ) Notice: Subject to any disclaimer, the term of this patent is extended or adjusted under 35 U.S.C. 154(b) by 393 days.

(21) Appl. No.: 17/511,655

(22) Filed: Oct. 27, 2021

(51) Int. Cl.
*B63B 29/06* (2006.01)
*B63B 29/04* (2006.01)

(52) U.S. Cl.
CPC ..... *B63B 29/06* (2013.01); *B63B 2029/043* (2013.01)

(58) Field of Classification Search
CPC ..... B63B 29/06; B63B 2029/043
See application file for complete search history.

(56) References Cited

U.S. PATENT DOCUMENTS 4,766,838 A 8/1988 Johnson
4,879,963 A * 11/1989 Dionne ..... B63B 29/04 297/188.21
5,197,406 A * 3/1993 Rabal ..... B63B 34/60 403/353
5,329,871 A * 7/1994 Gibbs ..... E05D 11/1007 114/363
5,346,415 A 9/1994 Waymon et al.
5,431,362 A * 7/1995 Carnahan ..... B63B 29/12 297/344.22
5,937,564 A * 8/1999 Perreault ..... A01K 97/10 43/4.5
5,992,804 A * 11/1999 Johnson ..... B63B 29/06 114/364
6,243,920 B1 * 6/2001 Sauve ..... E05D 3/18 16/361
6,536,726 B1 * 3/2003 Tull ..... B63B 15/02 248/500
9,027,501 B2 5/2015 Wood et al.
10,023,272 B1 * 7/2018 O'Neal, Jr. ..... B63B 29/06
10,167,894 B2 * 1/2019 James ..... F16C 11/0614
10,322,652 B2 * 6/2019 Beasley ..... B60N 2/502
10,407,139 B2 * 9/2019 Thomason ..... B63B 29/04
10,569,837 B2 2/2020 Kennemur
2013/0025525 A1 * 1/2013 Garelick ..... B63B 29/06 114/363

* cited by examiner

*Primary Examiner* — S. Joseph Morano
*Assistant Examiner* — Jovon E Hayes
(74) *Attorney, Agent, or Firm* — BUSINESS PATENT LAW, PLLC

(57) ABSTRACT

An adjustable support connected to a deck of an aquatic vessel for supporting a deck seat.

18 Claims, 6 Drawing Sheets

ADJUSTABLE SUPPORT FOR A DECK SEAT

PRIORITY

Applicant claims the benefit of Provisional Application 63/128,363—Adjustable Support for a Deck Seat—filed on Dec. 21, 2020.

BACKGROUND OF THE INVENTION

A. Field of the Invention

Among other things, the present invention is an adjustable support for a deck seat on board of an aquatic vessel.

B. Description of the Previous Art

Any discussion of references cited in this Description of the Previous Art merely summarizes the disclosures of the cited references and Applicant makes no admission that any cited reference or portion thereof is relevant prior art. Applicant reserves the right to challenge the accuracy, relevancy and veracity of the cited references.

References that may indicate a state-of-the-art for the current invention include: 1) U.S. Pat. No. 5,431,362-Carnahan, discloses an adjustable and transformable fixture support apparatus; 2) U.S. patent Ser. No. 10/407,139-Thomason discloses a system and method for supporting a pair of seats; 3) U.S. Pat. No. 5,992,804-Johnson discloses a seat pedestal assembly; 4) U.S. Pat. No. 5,346,415-Waymon, et al. discloses a support apparatus for use in a fishing boat; 5) U.S. Pat. No. 5,329,871-Gibbs discloses a support apparatus for use in a fishing boat; 6) U.S. Pat. No. 4,766,838-Johnson discloses an auxiliary boat seat; 7) U.S. Pat. No. 6,536,726-Tull discloses a mounting device for boat tower; 8) U.S. Pat. No. 9,027,501-Wood, et al. discloses a stand-up paddleboard stool; and 9) U.S. patent Ser. No. 10/569,837-Kennemur discloses a standing support assembly for boat deck.

Among other things, none of the above listed references disclose a base supporting a seat on a deck of an aquatic vessel; the base comprising: a) first and second legs creating a junction distinct from the deck; one of the legs comprising complimentary interlockers adapted to interact with interlockers of a section connected to the deck; b) an upright projection attached to the junction; the upright projection comprising a vertical slot; c) a pedestal comprising a segment comprising a fastener connecting the segment to the vertical slot; the segment further comprising a hollow section adapted to releasably engage the upright projection such that disengagement of the pedestal from the upright projection allows the first pedestal to be positioned at an angle other than perpendicular relative to the first junction.

SUMMARY OF THE INVENTION

Prior to the current invention, it is believed there was no mobile support for deck seats where the mobile support provided for the seat to be suspended above the deck of an aquatic vessel in a first operational mode while also allowing the seat to rest against the deck in a second operation mode. Meeting a long felt but unfilled need, among other things, the present invention allows the user to alter the field of vision of the operator of the aquatic vessel while still firmly securing the seat to the deck of the aquatic vessel during high velocity usage of the aquatic vessel.

An aspect of the present invention is to provide an adjustable support for a deck seat.

Still another aspect of the present invention is to provide an adjustable support for twin deck seats.

It is still another aspect of the present invention to provide an adjustable support for one or more deck seats where the length or the width of the support is adjustable.

A preferred embodiment of the current invention can be described as an adjustable support supporting two seats on a deck of an aquatic vessel; the adjustable support comprising: a) an elongate central section comprising a central bore and a bolt extending through the bore connecting the central section to the deck; the elongate central section further comprising first interlockers proximate a first end of the elongate central section and second interlockers proximate a second end of the elongate central section; b) a first base comprising: i) first and second horizontal legs creating a first junction; one of the legs comprising first complimentary interlockers adapted to interact with the first interlockers, wherein the first complimentary interlockers and the first interlockers allow adjustment of a length of the adjustable support; ii) a first upright projection, attached to the first junction, comprising a first vertical slot; iii) a first pedestal comprising: a first segment comprising a first fastener connecting the first segment to the first vertical slot; the first segment further comprising a first hollow section adapted to releasably engage the first upright projection such that: engagement of the first pedestal to the first upright projection allows the first hollow section to receive an extension of the first seat and support the first seat above the deck; and disengagement of the first pedestal from the first upright projection allows the first pedestal to be positioned at an angle other than perpendicular relative to the first junction; c) a second base comprising: i) third and fourth horizontal legs creating a second junction; one of the legs comprising first complimentary interlockers adapted to interact with the second interlockers, wherein the second complimentary interlockers and the second interlockers allow adjustment of a length of the adjustable support; ii) a second upright projection, attached to the second junction, comprising a second vertical slot; and iii) a second pedestal comprising: a second segment comprising a second fastener connecting the second segment to the second vertical slot; the second segment further comprising a second hollow section adapted to releasably engage the second upright projection such that: engagement of the second pedestal to the second upright projection allows the second hollow section to receive an extension of the second seat and support the second seat above the deck; and disengagement of the second pedestal from the second upright projection allows the second pedestal to be positioned at an angle other than perpendicular relative to the second junction.

Another preferred embodiment of the current invention can be described as an adjustable support supporting a seat on a deck of an aquatic vessel; the adjustable support comprising: a) an elongate section comprising a central bore and a bolt extending through the bore connecting the section to the deck; the elongate section further comprising interlockers proximate a first end of the central section; b) a base comprising: i) first and second legs creating a junction; one of the legs comprising complimentary interlockers adapted to interact with the interlockers, wherein the complimentary interlockers and the interlockers allow adjustment of a length of the adjustable support; ii) an upright projection, attached to the junction, comprising a vertical slot; iii) a pedestal comprising: a segment comprising a fastener connecting the segment to the vertical slot; the segment further comprising a hollow section adapted to releasably engage the upright projection such that: engagement of the pedestal to the upright projection allows the first hollow section to receive an extension of the seat and support the seat above the deck; and disengagement of the pedestal from the first upright projection allows the pedestal to be positioned at an angle other than perpendicular relative to the junction.

Still another preferred embodiment of the current invention can be described as a base supporting a seat on a deck of an aquatic vessel; the base comprising: a) first and second legs creating a junction distinct from the deck; one of the legs comprising complimentary interlockers adapted to interact with interlockers of a section connected to the deck; b) an upright projection attached to the junction; the upright projection comprising a vertical slot; c) a pedestal comprising a segment comprising a fastener connecting the segment to the vertical slot; the segment further comprising a hollow section adapted to releasably engage the upright projection such that disengagement of the pedestal from the upright projection allows the first pedestal to be positioned at an angle other than perpendicular relative to the first junction.

It is the novel and unique interaction of these simple elements which creates the apparatus and methods, within the ambit of the present invention. Pursuant to Title 35 of the United States Code, descriptions of preferred embodiments follow. However, it is to be understood that the best mode descriptions do not limit the scope of the present invention.

DESCRIPTION OF THE PREFERRED EMBODIMENTS

Figure 1:
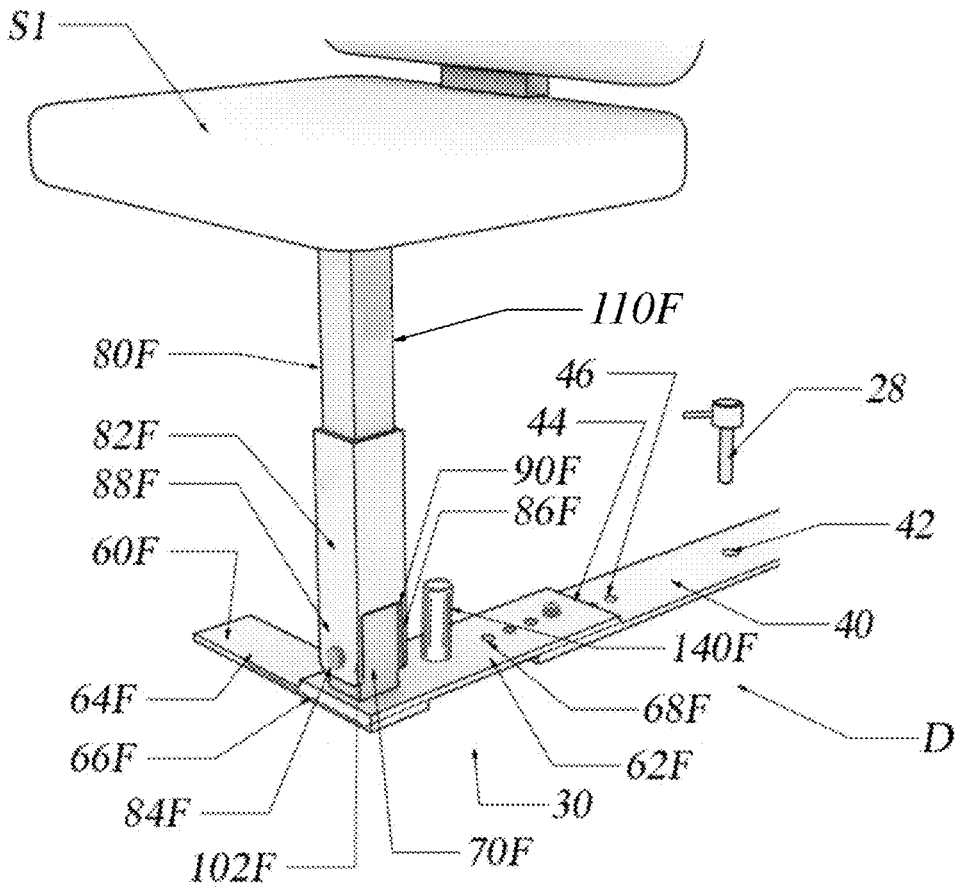
FIG. 1 is a perspective of a preferred embodiment of the adjustable support securing a seat to a deck.
Figure 2:
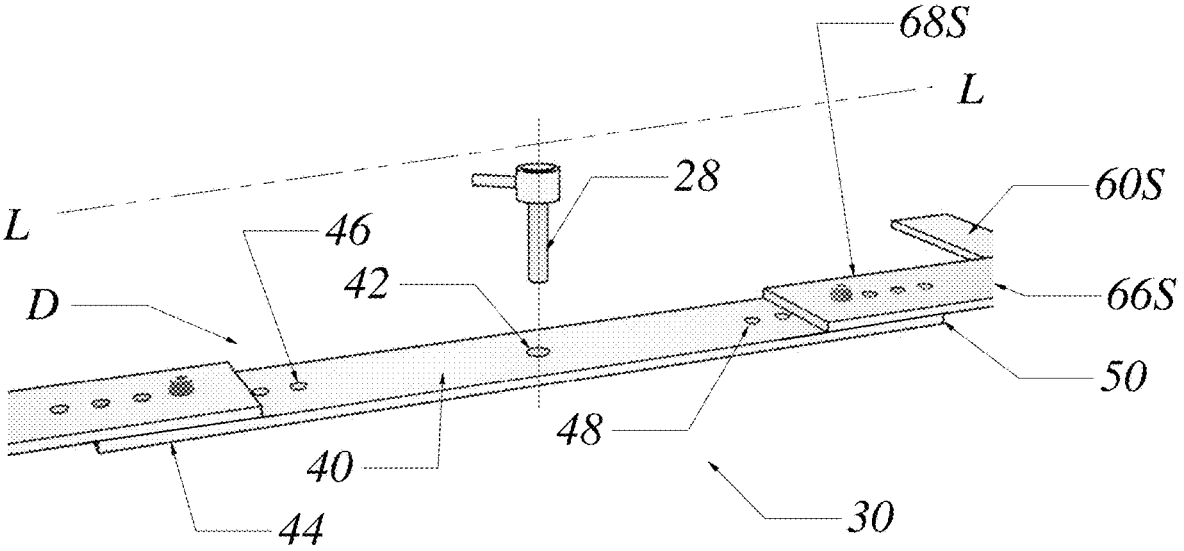
FIG. 2 is a perspective of central section, first base and second base of the adjustable support securing a seat to a deck.
Figure 3:
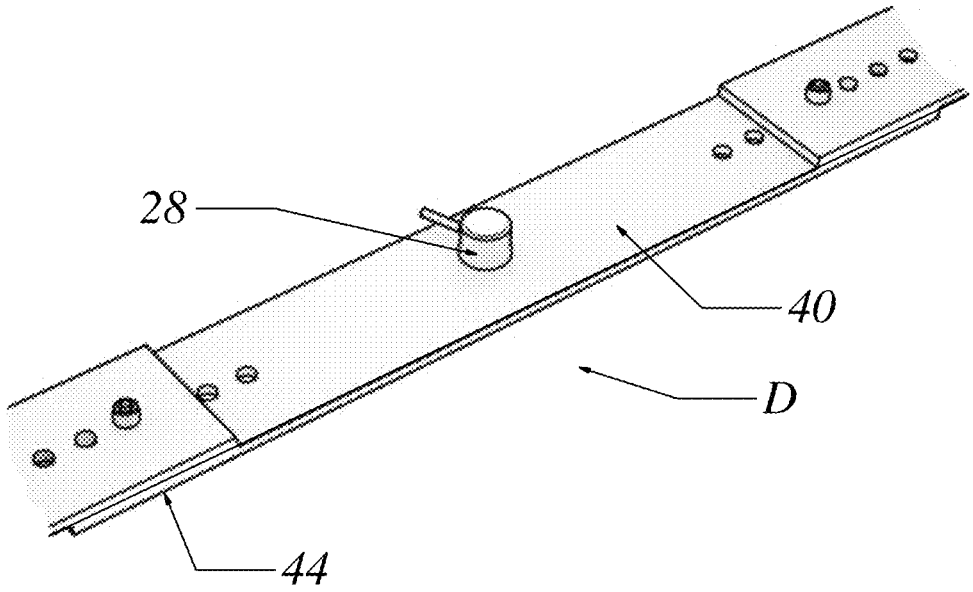
FIG. 3 is a perspective of central section, first base and second base of the adjustable support securing a seat to a deck.
Figure 4:
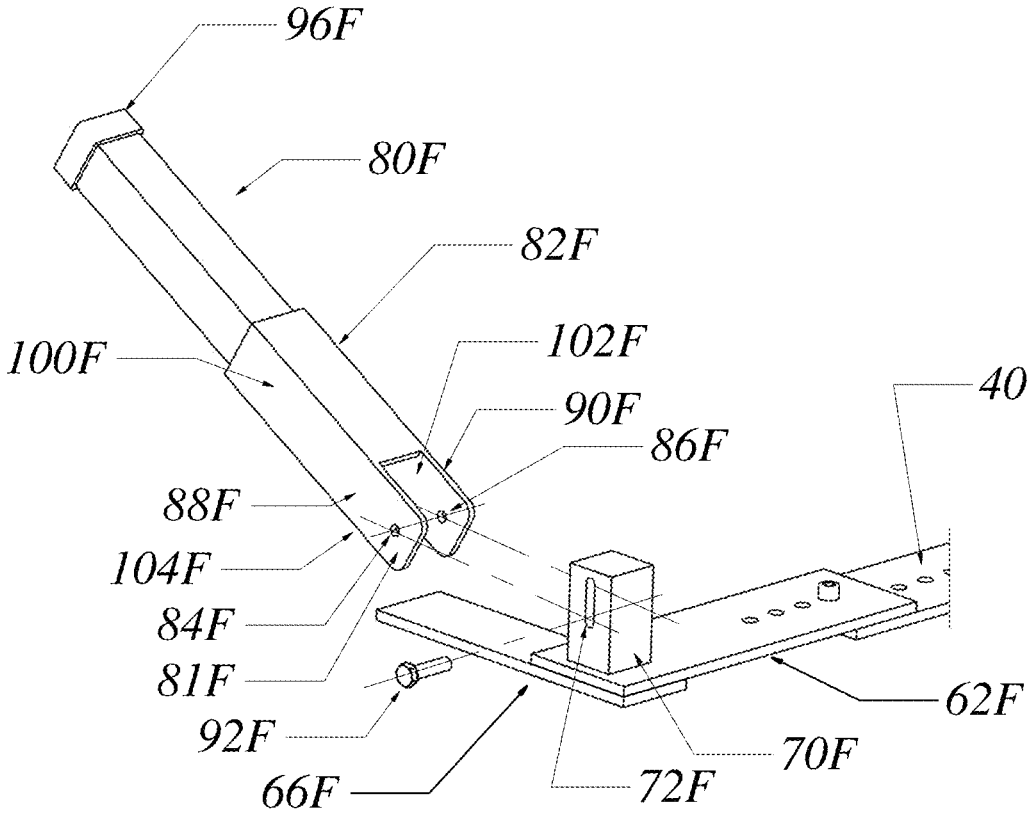
FIG. 4 is an exploded perspective of first horizontal leg, second horizontal leg, first junction, first upright projection and first pedestal of the adjustable support.
Figure 4A:
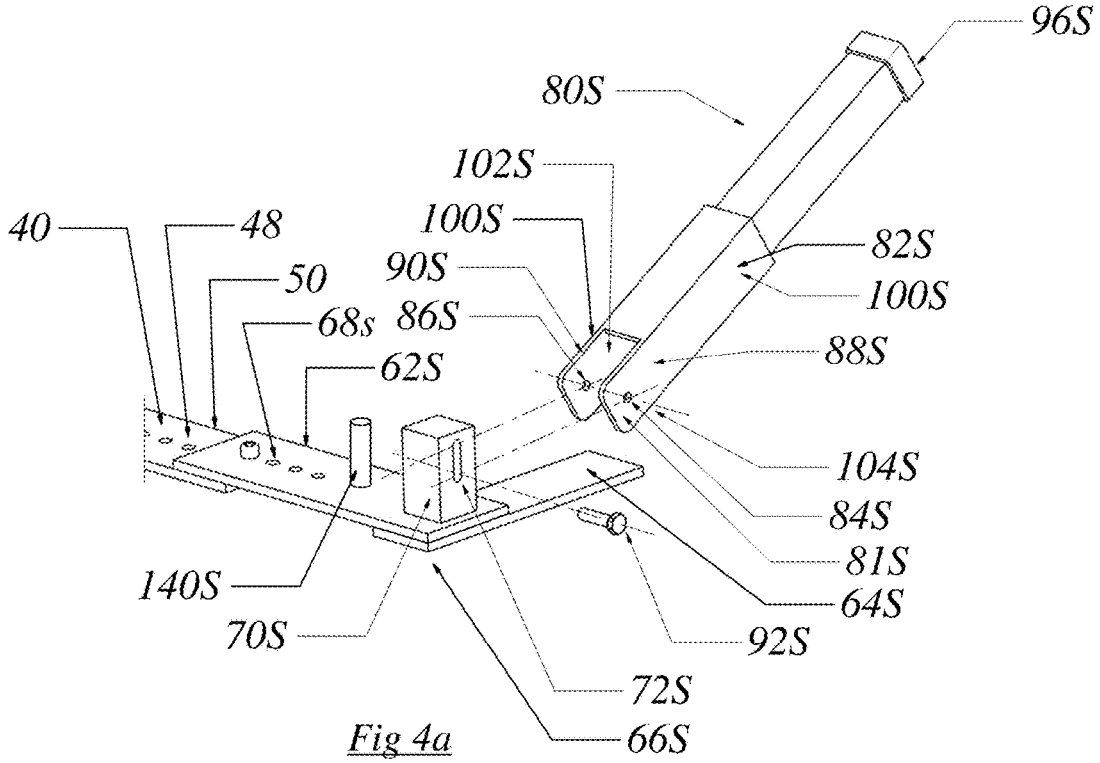
FIG. 4*a* is an exploded perspective of second junction, second upright projection and second pedestal of the adjustable support.
Figure 5:
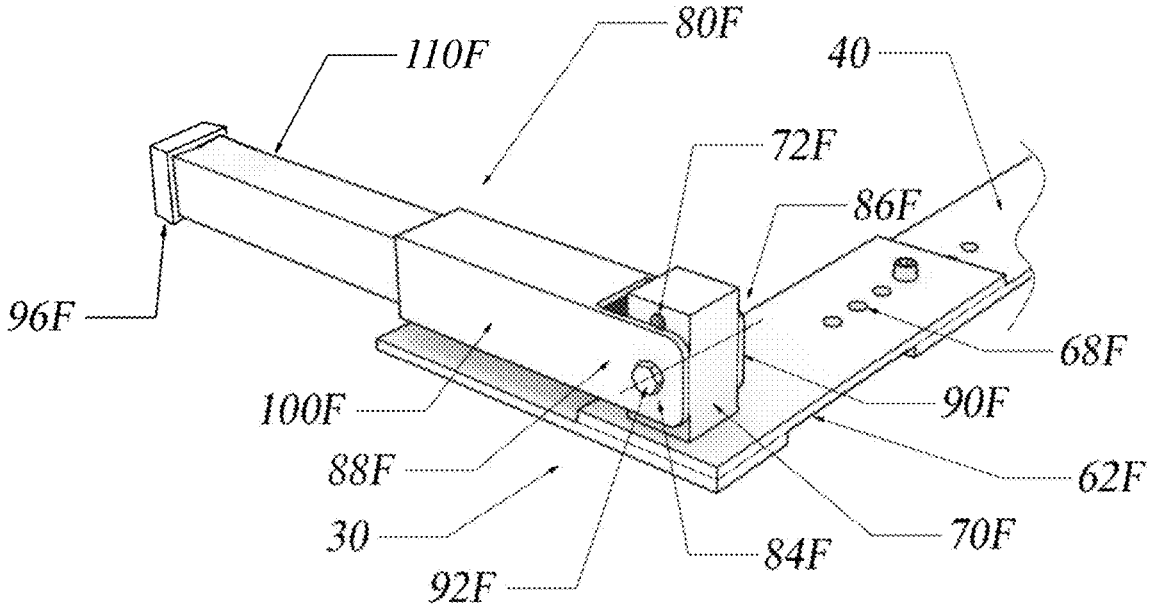
FIG. 5 is another perspective of first junction, first upright projection and first pedestal of the adjustable support.
Figure 5A:
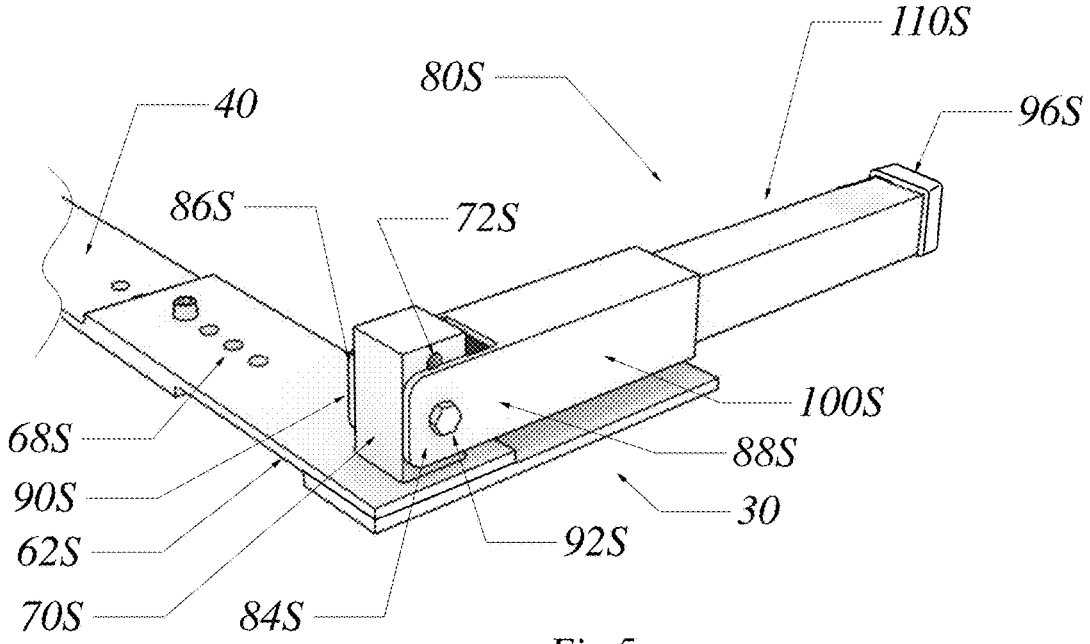
FIG. 5*a* is another perspective of second junction, second upright projection and second pedestal of the adjustable support.
Figure 6:
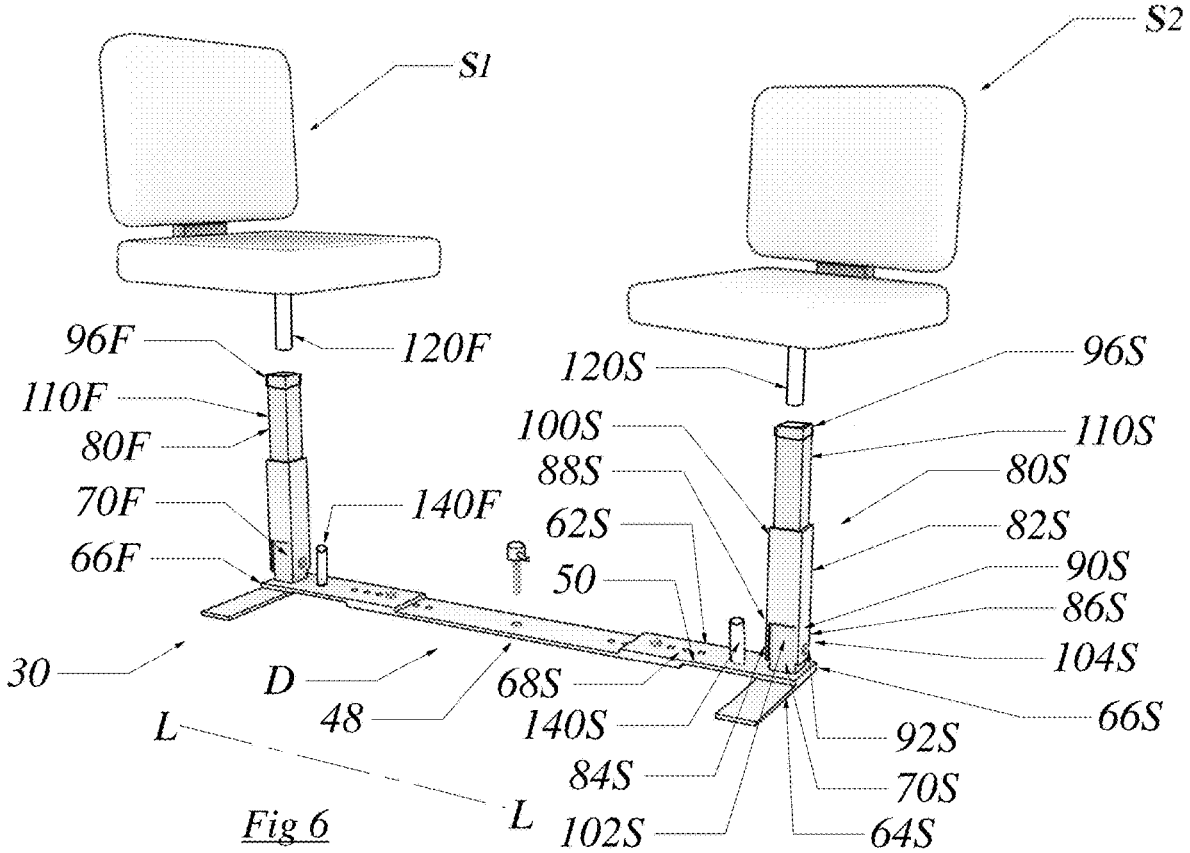
FIG. 6 is a perspective of a preferred embodiment of the current invention where the adjustable support connects twin seats to the deck of an aquatic vessel.

Although the disclosure hereof is detailed to enable those skilled in the art to practice the invention, the embodiments published herein merely exemplify the present invention.

Within the scope of the current invention, seat (S1) is connected to adjustable support (30) by any means acceptable in the art. By way of illustration, a rod attached to the bottom of seat (S1) can extend into to adjustable support (30) for connecting seat (S1) to adjustable support (30).

With reference to FIGS. 1-9, adjustable supports for connecting single or twin seats to the deck (D) of an aquatic vessel are disclosed and enabled.

FIGS. 1-6 portray a first preferred embodiment of the current invention. Via bolt (28), adjustable support (30) is connected to deck (D) of an aquatic vessel (not shown in the Drawings). In select preferred embodiments, adjustable support (30) is provided with elongate central section (40) including bore (42) which may or may not be centered in elongate central section (40). Bolt (28) extending through bore (42) connects central section (40) to the deck (D). Central section (40) is also provided with one or more first interlockers (46) proximate a first of end (44) of elongate central section (40) and one or more second interlockers (48) proximate a second end (50) of elongate central section (40).

First base (60F) can be connected with central section (40). First base (60F) is provided with first and second horizontal legs (62F, 64F) joined with each other at approximately a ninety degree angle creating a first junction (66F). First leg (62F) can include one or more first complimentary interlockers (68F). First complimentary interlockers (68F) are adapted to interact with the first interlockers (46) proximate the first end (44) of the elongate central section (40). First complimentary interlockers (68F) and first interlockers (46) allow adjustment of the length (L-L) of the adjustable support (30).

Within the scope of the current invention, first upright projection (70F) is attached to first junction (66F). First upright projection (70F) is provided with first vertical slot (72F) parallel first leg (62F).

The present adjustable support (30) includes a first pedestal (80F). Pedestal (80F) includes first segment (82F) proximate first junction (66F). First segment (82F) can be provided with first and second opposed apertures (84F, 86F) positioned on first and second arms (88F, 90F) outward from the first upright projection (70F). As shown, first and second opposed apertures (84F, 86F) are aligned with first vertical slot (72F) of first upright projection (70F). In operation of this preferred embodiment, first fastener (92F) extends through first vertical slot (72F) and first and second opposed apertures (84F, 86F) to allow mobility of first pedestal (80F) while simultaneously securing first pedestal (80F) to first upright projection (70F). First hollow section (100F) of first pedestal (80F) proximate the first junction (66F) can include first and second opposed openings (102F, 104F) transverse to the first vertical slot (72F). The combination of first vertical slot (72F), first hollow section (100F) proximate the first junction (66F) and the first and second arms (88F, 90F) allow the first segment (82F) to engage or disengage first upright projection (70F). Disengagement of first pedestal from the first upright projection (70F) allows first pedestal (80F) to be positioned at an angle other than perpendicular relative to first junction (66F). When required, the mobility of first pedestal (80F) allows the user of the current invention to rest seat (S1) on deck (D) while still securing seat (S1) to vessel.

Second base (60S) can be connected with central section (40). Second base (60S) is provided with third and fourth horizontal legs (62S, 64S) joined with each other at approximately a ninety degree angle creating a second junction (66S). Third leg (62S) can include one or more second complimentary interlockers (68S). Second complimentary interlockers (68S) are adapted to interact with the second interlockers (48) proximate the second end (50) of the elongate central section (40). Second complimentary interlockers (68S) and second interlockers (48) allow adjustment of the length (L-L) of the adjustable support (30). The combination of first complimentary interlockers (68F), first interlockers (46), second complimentary interlockers (68S) and second interlockers (48) allow the length (L-L) of the adjustable support (30) to range from about 26 inches to about 40 inches. The combination of first complimentary interlockers (68F) and first interlockers (46) allows adjustment of the length of the first side of adjustable support (30) of up to about seven inches. And the combination of second complimentary interlockers (68S) and second interlockers (48) allows adjustment of the length of the second side of adjustable support (30) of up to about seven inches.

Within the scope of the current invention, second upright projection (70S) is attached to second junction (66S). Second upright projection (70S) is identical to upright projection (70F) and is provided with second vertical slot (72S) parallel third leg (62S).

Select preferred embodiments of the current invention include a second pedestal (80S). By way of illustration, the present adjustable support (30) can include a second pedestal (80S). Pedestal (80S) includes second segment (82S) proximate second junction (66S). Second segment (82S) can be provided with third and fourth opposed apertures (84S, 86S) positioned on third and fourth arms (88S, 90S) outward from the second upright projection (70S). As shown, third and fourth opposed apertures (84S, 86S) are aligned with second vertical slot (72S) of second upright projection (70S). In operation of this preferred embodiment, second fastener (92S) extends through second vertical slot (72S) and third and fourth opposed apertures (84S, 86S) to allow mobility of second pedestal (80S) while simultaneously securing second pedestal (80S) to second upright projection (80S). Third hollow section (100S) of second pedestal (80S) proximate the second junction (66S) can include third and fourth opposed openings (102S, 104S) transverse to the second vertical slot (72S). The combination of second vertical slot (72S), third hollow section (100S) proximate the second junction (66S) and the third and fourth arms (88S, 90S) allow the third segment (82S) to engage or disengage second upright projection (70S). Disengagement of second pedestal (80S) from the second upright projection (70S) allows second pedestal (80S) to be positioned at an angle other than perpendicular relative to second junction (66S). When required, the mobility of second pedestal (80S) allows the user of the current invention to rest seat (S2) on deck (D) while still securing seat (S2) to vessel.

Select preferred embodiments of first pedestal (80F) and include first collar (96F). Second pedestal (80S) can be provided with second collar (96S). Other preferred embodiments of adjustable support (30) can include first upright pipe (140F), of lesser length than the first pedestal (80F), mounted to one of the first or second horizontal legs (62F, 64F) and/or a second upright pipe (140S), of lesser length than the second pedestal (80S), mounted to one of the third or fourth horizontal legs (62S, 64S).

Figure 7:
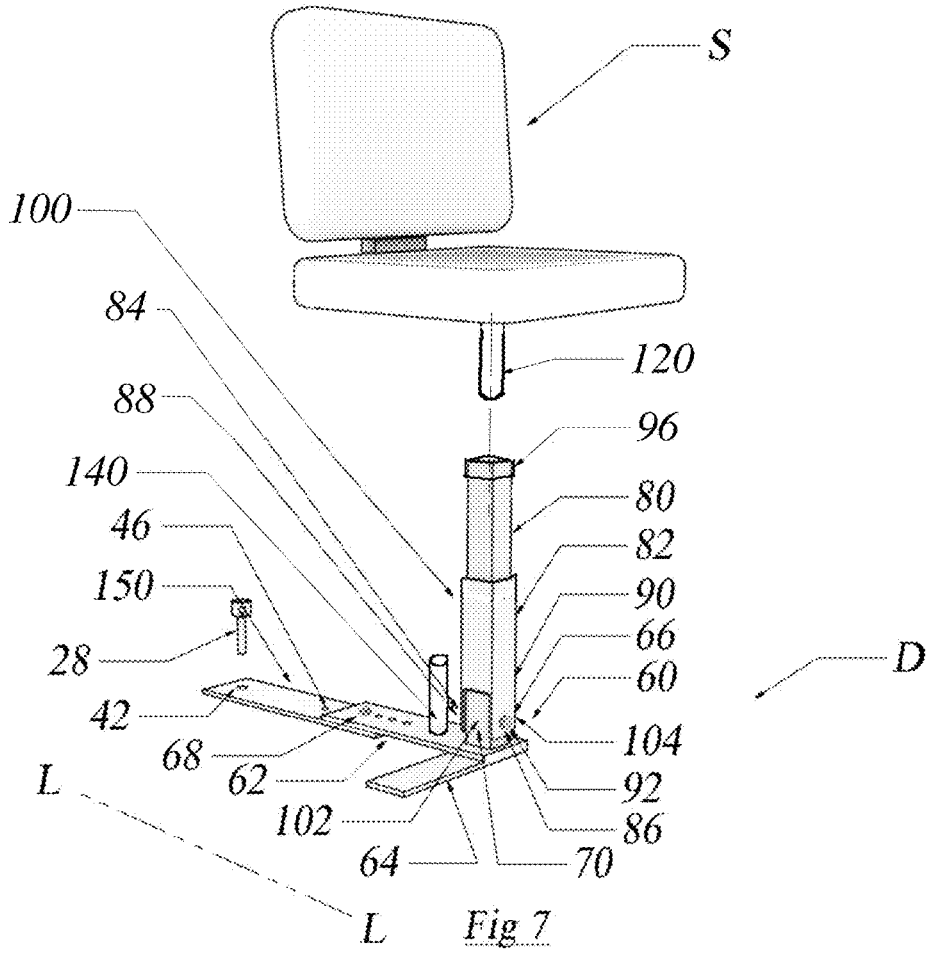
FIG. 7 is a perspective of another preferred embodiment of the current invention where the adjustable support connects a single seat to the deck of an aquatic vessel.
Figure 8:
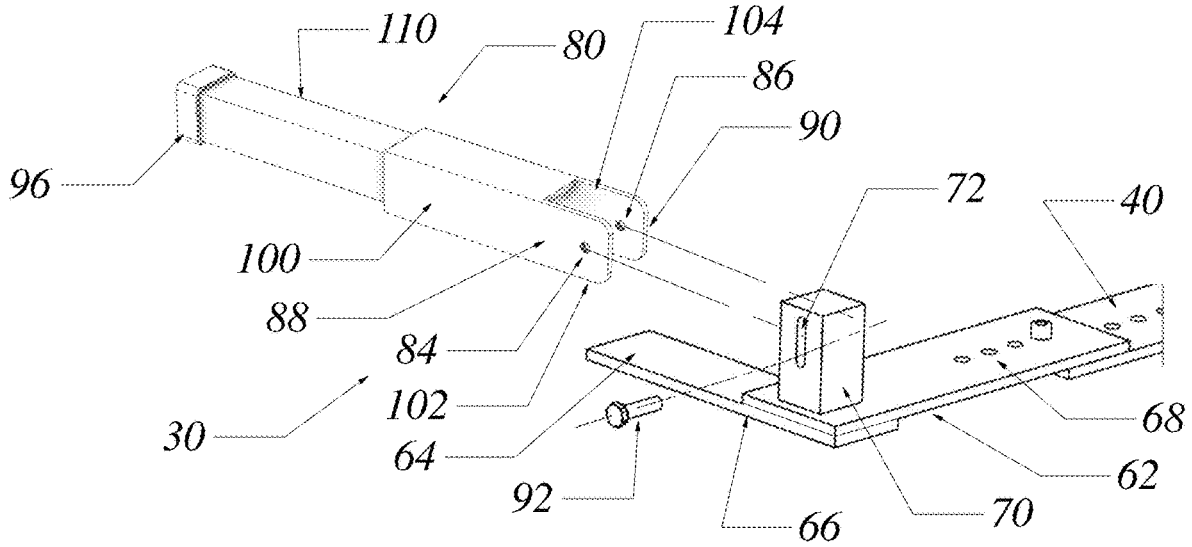
FIG. 8 is an exploded perspective of junction, upright projection and pedestal of the adjustable support.

FIGS. 7 and 8 are perspectives of a preferred embodiment of the current invention where the adjustable support (30) connects a single seat (S) to the deck (D) of an aquatic vessel.

Adjustable support (30) is provided with plate (150) which can be elongate, round or any other configuration acceptable in the art. Plate (150) includes bore (42). Bolt (28) extending through bore (42) connects plate (150) to the deck (D). Plate (150) is also provided with one or more interlockers (46).

Base (60) can be connected with plate (150). Base (60) is provided with first and second horizontal legs (62, 64) joined with each other at approximately a ninety degree angle creating a first junction (66). First leg (62) can include one or more complimentary interlockers (68). Complimentary interlockers (68F) are adapted to interact with the interlockers (46) of plate (150). Complimentary interlockers (68) and interlockers (46) allow adjustment of the length (L-L) of the adjustable support (30).

Upright projection (70) is attached to junction (66). Although not shown in this view, upright projection (70) is provided with vertical slot (72) parallel first leg (62). Pedestal (80) includes first segment (82) proximate first junction (66). First segment (82) can be provided with first and second opposed apertures (84, 86) positioned on first and second arms (88, 90) outward from the first upright projection (70). First and second opposed apertures (84, 86) are aligned with vertical slot (72) of first upright projection (70). In operation of this preferred embodiment, fastener (92) extends through vertical slot (72) and first and second opposed apertures (84, 86) to allow mobility of pedestal (80) while simultaneously securing pedestal (80) to upright projection (70). First hollow section (100) of pedestal (80) proximate the junction (66) can include first and second opposed openings (102, 104) transverse to the vertical slot (72). The combination of vertical slot (72), first hollow section (100) proximate the first junction (66) and the first and second arms (88, 90) allow segment (82) to engage or disengage upright projection (70). Disengagement of pedestal from the upright projection (70) allows pedestal (80) to be positioned at an angle other than perpendicular relative to first junction (66). When required, the mobility of first pedestal (80) allows the user of the current invention to rest seat (S1) on deck (D) while still securing seat (S1) to vessel.

Select preferred embodiments of pedestals (80F, 80S, 80) can include collar (96F, 96S, 96). Other preferred embodiments of adjustable support (30) can include upright pipe (140F, 140S, 140) of lesser length than the pedestals (80F, 80S, 80). Pipes (140F, 140S, 140) can be mounted to one of the horizontal legs (62F, 62S, 64F, 64S, 62, 64) of adjustable support (30). Seats (S1, S2, S) can include extensions (120F, 1205, 120) that fit into collars or bushings (96F, 96S, 96) of hollow sections (110F, 1105, 110) of pedestals (80F, 80S, 80). Extensions (120F, 1205, 120) can also be can be configured to fit into pipes (140F, 140S, 140).

Figure 9:
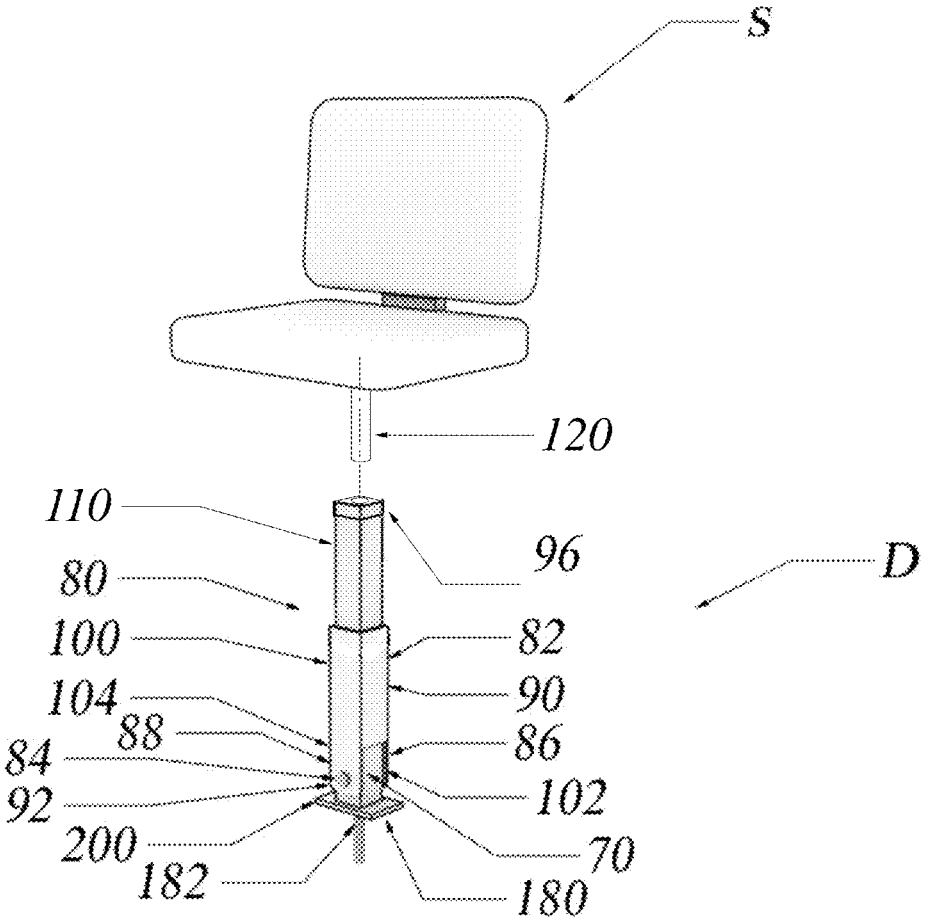
FIG. 9 is a perspective of still another preferred embodiment of the current invention where the adjustable support connects a single seat to the deck of an aquatic vessel.

FIG. 9 is a perspective of still another preferred embodiment of the current invention where the adjustable support connects a single seat to the deck of an aquatic vessel. For this embodiment, the adjustable support is adapted to engage a premanufactured opening of deck (D) of aquatic vessel. Shaft (180) engages premanufactured opening of deck (D). Coupler (200) is connected to superior end (182) of shaft (180). Upright projection (70) includes vertical slot (72—not shown in this view) and is mounted to coupler (200).

Pedestal (80) includes first segment (82) proximate coupler (200). First segment (82) can be provided with first and second opposed apertures (84, 86) positioned on first and second arms (88, 90) outward from the first upright projection (70). First and second opposed apertures (84, 86) are aligned with vertical slot (72) (not shown in this view) of first upright projection (70). In operation of this preferred embodiment, fastener (92) extends through vertical slot (72) and first and second opposed apertures (84, 86) to allow mobility of pedestal (80) while simultaneously securing pedestal (80) to upright projection (70). First hollow section (100) of pedestal (80) proximate coupler (200) can include first and second opposed openings (102, 104) transverse to the vertical slot (72). The combination of vertical slot (72), first hollow section (100) proximate coupler (200) and the first and second arms (88, 90) allow segment (82) to engage or disengage upright projection (70). Disengagement of pedestal from the upright projection (70) allows pedestal (80) to be positioned at an angle other than perpendicular relative to coupler (200). When required, the mobility of first pedestal (80) allows the user of the current invention to rest seat (S1) on deck (D) while still securing seat (S1) to vessel.

Seat (S) can include extension (120) that fits into collar or bushing (96) of hollow section (110) of pedestal (80).

Applicant has enabled, described and disclosed the invention as required by Title 35 of the United States Code and/or the Articles of the Patent Cooperation Treaty.

What is claimed is:

1. An adjustable support supporting two seats on a deck of an aquatic vessel; the adjustable support comprising:

a) an elongate central section comprising a central bore and a bolt extending through the bore connecting the central section to the deck; the elongate central section further comprising first interlockers proximate a first end of the elongate central section and second interlockers proximate a second end of the elongate central section;

b) a first base comprising:

i) first and second horizontal legs creating a first junction; one of the legs comprising first complimentary interlockers adapted to interact with the first interlockers, wherein the first complimentary interlockers and the first interlockers allow adjustment of a length of the adjustable support;

ii) a first upright projection, attached to the first junction, comprising a first vertical slot;

iii) a first pedestal comprising:

a first segment comprising a first fastener connecting the first segment to the first vertical slot; the first segment further comprising a first hollow section adapted to releasably engage the first upright projection such that:

engagement of the first pedestal to the first upright projection allows the first hollow section to receive an extension of the first seat and support the first seat above the deck; and disengagement of the first pedestal from the first upright projection allows the first pedestal to be positioned at an angle other than perpendicular relative to the first junction;

c) a second base comprising:

i) third and fourth horizontal legs creating a second junction; one of the legs comprising first complimentary interlockers adapted to interact with the second interlockers, wherein the second complimentary interlockers and the second interlockers allow adjustment of a length of the adjustable support;

ii) a second upright projection, attached to the second junction, comprising a second vertical slot; and iii) a second pedestal comprising:

a second segment comprising a second fastener connecting the second segment to the second vertical slot; the second segment further comprising a second hollow section adapted to releasably engage the second upright projection such that:

engagement of the second pedestal to the second upright projection allows the second hollow section to receive an extension of the second seat and support the second seat above the deck; and disengagement of the second pedestal from the second upright projection allows the second pedestal to be positioned at an angle other than perpendicular relative to the second junction.

2. The adjustable support of claim 1, wherein:

a) the first pedestal comprises first and second arms and first and second opposed openings proximate the first vertical slot; and b) the second pedestal comprises third and fourth arms and third and fourth opposed openings proximate the second vertical slot.

3. The adjustable support of claim 2 comprising:

a) a first upright pipe, of lesser length than the first pedestal, mounted to one of the first or second horizontal legs; and b) a second upright pipe, of lesser length than the second pedestal, mounted to one of the third or fourth horizontal legs.

4. The adjustable support of claim 3, wherein:

a) the first pedestal comprises a first collar; and b) the second pedestal comprises a second collar.

5. The adjustable support of claim 4, wherein:

a) the first and second horizontal legs creating the first junction intersect at or about a 90 degree angle; and b) the third and fourth horizontal legs creating the second junction intersect at or about a 90 degree angle.

6. An adjustable support supporting a seat on a deck of an aquatic vessel; the adjustable support comprising:

a) an elongate section comprising a central bore and a bolt extending through the bore connecting the section to the deck; the elongate section further comprising interlockers proximate a first end of the central section;

b) a base comprising:

i) first and second legs creating a junction; one of the legs comprising complimentary interlockers adapted to interact with the interlockers, wherein the complimentary interlockers and the interlockers allow adjustment of a length of the adjustable support;

ii) an upright projection, attached to the junction, comprising a vertical slot;

iii) a pedestal comprising:

a segment comprising a fastener connecting the segment to the vertical slot; the segment further comprising a hollow section adapted to releasably engage the upright projection such that:

engagement of the pedestal to the upright projection allows the first hollow section to receive an extension of the seat and support the seat above the deck; and disengagement of the pedestal from the first upright projection allows the pedestal to be positioned at an angle other than perpendicular relative to the junction.

7. The adjustable support of claim 6, wherein the pedestal comprises first and second arms and first and second opposed openings proximate the vertical slot.

8. The adjustable support of claim 7 comprising an upright pipe, of lesser length than the pedestal, mounted to one of the first or second legs.

9. The adjustable support of claim 8, wherein the pedestal comprises a collar.

10. The adjustable support of claim 9 wherein the first and second legs creating the junction intersect at or about a 90 degree angle.

11. A base supporting a seat on a deck of an aquatic vessel; the base comprising:

a) first and second legs creating a junction distinct from the deck; one of the legs comprising complimentary interlockers adapted to interact with interlockers of a section connected to the deck;

b) an upright projection attached to the junction; the upright projection comprising a vertical slot;

c) a pedestal comprising a segment comprising a fastener connecting the segment to the vertical slot; the segment further comprising a hollow section adapted to releasably engage the upright projection such that disengagement of the pedestal from the upright projection allows the first pedestal to be positioned at an angle other than perpendicular relative to the first junction.

12. The base of claim 11, wherein engagement of the pedestal to the upright projection allows the first hollow section to receive an extension of the seat and support the seat above the deck.

13. The base of claim 12, wherein the pedestal comprises first and second arms out of and proximate to the vertical slot.

14. The base of claim 13, wherein the segment comprises first and second opposed openings, proximate the vertical slot, adapted to receive fastener.

15. The base of claim 14 comprising an upright pipe mounted to one of the first or second legs.

16. The base of claim 14, wherein the pedestal comprises a collar.

17. The base of claim 16, wherein the first and second legs creating the junction intersect at or about a 90 degree angle.

18. The base of claim 17, wherein the upright pipe is of lesser length than the pedestal.

* * * * *